US006852276B2

(12) United States Patent
Kim

(10) Patent No.: US 6,852,276 B2
(45) Date of Patent: Feb. 8, 2005

(54) CAST IRON WITH IMPROVED OXIDATION RESISTANCE AT HIGH TEMPERATURES

(75) Inventor: Hak Jin Kim, Kyungki-do (KR)

(73) Assignee: Hyundai Motor Company, Seoul (KR)

( * ) Notice: Subject to any disclaimer, the term of this patent is extended or adjusted under 35 U.S.C. 154(b) by 151 days.

(21) Appl. No.: 10/295,553

(22) Filed: Nov. 15, 2002

(65) Prior Publication Data

US 2003/0129073 A1 Jul. 10, 2003

(30) Foreign Application Priority Data

Dec. 27, 2001 (KR) ..... 2001-85825

(51) Int. Cl.[7] ..... C22C 37/08; C22C 37/10
(52) U.S. Cl. ..... 420/96; 420/97; 420/98
(58) Field of Search ..... 420/96, 97, 98, 420/13, 15, 16, 17

(56) References Cited

U.S. PATENT DOCUMENTS 4,396,442 A * 8/1983 Nakamura et al. ..... 148/138
4,426,426 A * 1/1984 Muhlberger ..... 428/682
4,518,563 A * 5/1985 Suganuma et al. ..... 419/29
4,528,045 A * 7/1985 Tanaka et al. ..... 148/35
4,545,825 A * 10/1985 Miyata et al. ..... 148/3
4,863,533 A * 9/1989 Hanakawa et al. ..... 148/141
5,853,504 A * 12/1998 Nishimura ..... 148/324
6,095,958 A * 8/2000 Maderud et al. ..... 492/54
6,110,084 A * 8/2000 Kanno et al. ..... 492/1

OTHER PUBLICATIONS

"A Versatile Material: Austenitic Cast Iron," Deutscher Gieβereiverband (DGV), Oct. 23, 2000; http://www.dgv.de/presse/2000/3–press2000–10.htm.

* cited by examiner

*Primary Examiner*—Daniel Jenkins
(74) *Attorney, Agent, or Firm*—Morgan Lewis & Bockius LLP

(57) ABSTRACT

An iron cast having iron as a major component, and including C, Si, Mn, Cr, Mo and Ni, where the cast iron provides excellent heat resistance and oxidation resistance at high temperatures. The cast iron beneficially contains between 2.5 to 3.0% of C; 2.0 to 3.0% of Si; 0.8 to 1.2% of Mn; 1.7 to 3.0% of Cr; 0.025 to 0.06% of Mg; 0.15 to 0.4% of Mo; and 17.0 to 20.0% of Ni; but less than 0.1% of P; and less than 0.02% of S. The cast iron is suitable for extremely severe conditions at high temperatures, and can be used for an exhaust manifold for engines where temperature of the manifold may reach 850° C.

20 Claims, 1 Drawing Sheet

CAST IRON WITH IMPROVED OXIDATION RESISTANCE AT HIGH TEMPERATURES

FIELD OF THE INVENTION

The present invention relates to a cast iron with improved oxidation resistance at high temperature. More particularly, it relates to an iron cast comprising a cast iron as a major component, C, Si, Mn, P, S, Cr, Mo and Ni, where the cast iron provides excellent heat resistance and oxidation resistance at high temperature, thus being suitable for an exhaust manifold for engines exposed to extremely severe conditions at high temperature.

BACKGROUND OF THE INVENTION

An exhaust manifold is a pipe that conducts the exhaust gases from the combustion chambers to the exhaust pipe. The size and design of the exhaust manifold is closely related with the power of engines because the manifold is located in the first portion to receive exhaust gases from the head.

Conventional oxidation resistant cast irons such as FCD50M, FCD45F, FCD-H, and FCD-50HS have compositions in Table 1. These cast irons contain Si and/or Mo added to the conventional spherical cast iron to improve physical properties and oxidation resistance at high temperature.

TABLE 1

Prior Art Cast Iron Formulations

| Products | C | Si | Mn | P | S | Cr | Mg | Mo | Ni | Fe |
|---|---|---|---|---|---|---|---|---|---|---|
| FCD50M | 3.0–4.0 | 2.0–3.0 | 0.2–0.6 | Below 1.0 | Below 0.02 | Below 0.3 | Above 0.025 | — | — | Balance |
| FCD-J | 3.0–4.0 | 2.0–3.0 | 0.2–0.6 | Below 0.1 | — | — | Above 0.015 | — | Below 1.0 | Balance |
| FCD-M | 3.0–4.0 | 3.8–4.0 | Below 0.6 | Below 0.04 | Below 0.02 | — | 0.04–0.065 | 0.5–0.7 | — | Balance |
| FCD-H | 3.2–3.9 | 3.2–3.8 | Below 0.3 | — | — | — | Above 0.02 | — | — | Balance |
| FCD50HS | 3.3–3.8 | 3.4–3.8 | Below 0.6 | Below 0.1 | Below 0.015 | — | Above 0.025 | 0.4–0.5 | Below 1.0 | Balance |

There are three requirements of the metal—high temperature strength, high temperature oxidation resistance both (when exposed to the atmosphere and also when exposed to exhaust gases), and compatibility with catalysts. If an exhaust system using heat resistant cast iron is held at a temperature of 630° C. to 760° C. which may typically be encountered in use, tensile strength of the prior art oxidation resistant cast irons is generally at least about 75 Mpa. However, the strength of cast iron metals declines with temperature.

The various grades of austenitic cast iron display a wide variety of properties, which is why they are being employed in numerous technical applications. The DIN 1694 standard recognizes eight lamellar-graphite and fourteen spherolitic-graphite variants. Their outstanding properties include high-temperature stability, oxidation resistance, unusual heat-expansion coefficients (from high to low), favorable running properties, corrosion resistance, low-temperature toughness, and erosion resistance. An austentic cast iron according to DIN 1694 may have up to 3% carbon, 1.5–3% Si, 0.5–1.5% Mn, 18–22% Ni, and 1–2.5% Cr.

Recent innovations in design of exhaust system of automobiles requires the iron to have high performance (high tensile strength) at a temperature of 730° C. to 900° C. It is also advantageous to produce the exhaust system with a cast iron having excellent oxidation resistance at elevated temperatures, and also with high catalyst compatibility to be responsive to restrictive regulations on exhaust gases that result from increase in the power of automobiles. Conventional cast iron cannot properly meet these criteria. Therefore, the demand to obtain materials having superiority in these many characteristics has been highly increased.

SUMMARY OF THE INVENTION

Accordingly, an object of the present invention is to provide cast iron having excellent high temperature strength and high temperature oxidation resistance.

Use of special alloy elements such as Mo, Ni and Cr were thought to be a solution on the base that tensile strength at high temperature is proportional to fatigue resistance and creep properties. The inventors have found that by adding at least some of C, Si, Mn, P, S, Cr, Mg, Mo and Ni in particular amounts to a cast iron, a cast iron can be produced beneficially having: austenitic structure of at least 75% of spherodization rate, below 70 m of graphite grain size, and below 5% of glass cementite. Additionally, heat resistance—that is, strength at elevated temperatures—and oxidation resistance at high temperature can be improved over conventional prior art oxidation resistant cast irons.

In one embodiment the cast iron includes: 2.5 to 3.0% of C; 2.0 to 3.0% of Si; 0.8 to 1.2% of Mn; 0 to 0.1% of P; 0.001 to 0.02% of S; 1.7 to 3.0% of Cr, 0.025 to 0.06% of Mg; 0.15 to 0.4% of Mo; 17.0 to 20.0% of Ni; and balance of Fe to the cast iron. In one embodiment this cast iron has an austenitic structure having 75% to 100% of spherodization rate, 10 to 70 m of graphite grain size, and 0 to 5% of glass cementite. In an alternate embodiment this cast iron has 2.4 to 2.7% of Si; 0.001 to 0.02% of P; 0.001 to 0.01% of S; and 0.03 to 0.05% of Mg. In an alternate embodiment this cast iron has 2.6 to 2.8% of C; 0.9 to 1.1% of Mn; less than 0.05% of P; less than 0.01% of S; 2.6 to 3.0% of Cr; 0.2 to 0.3% of Mo; and 17.0 to 19.0% of Ni. In an alternate embodiment this cast iron has 2.6 to 2.8% of C; 2.4 to 2.7% of Si; 0.9 to 1.1% of Mn; less than 0.05% of P; 0.001 to 0.01% of S; 2.2 to 2.5% of Cr; 0.03 to 0.05% of Mg; less than 0.01% of S; and 0.2 to 0.3% of Mo.

In an alternate low nickel embodiment each of the above cast iron formulations has about 17.5% of Ni, that is, less than 18% Ni. In an alternate embodiment each of the above cast iron formulations is substantially free of copper and aluminum.

Preferably this cast iron has a tensile strength of at least 10 kgf/mm$^2$ at a temperature of 700° C. More preferably this cast iron has a tensile strength of at least 15 kgf/mm$^2$ at a temperature of 700° C. Preferably this cast iron has a tensile strength of at least 10 kgf/mm$^2$ at a temperature 800° C. Preferably the above cast iron formulations exhibit less than about 0.05 milligrams, more preferably less than about 0.04 milligrams, of metal conversion to oxide per square centimeter when exposed to air at 760° C. for 50 hours.

The invention also comprises an exhaust manifold containing a cast iron material of one of the above embodiments. For example the exhaust manifold may be at least in part made from a cast iron material having 2.5 to 3.0% of C; 2.0 to 3.0% of Si; 0.8 to 1.2% of Mn; less than 0.1% of P; less than 0.02% of S; 1.7 to 3.0% of Cr; 0.025 to 0.06% of Mg; 0.15 to 0.4% of Mo; 17.0 to 20.0% of Ni; and a balance of iron. Beneficially this cast iron material making the exhaust manifold has a tensile strength of at least 10 kgf/mm$^2$ at a temperature of 800° C. In one embodiment this cast iron material making the exhaust manifold has about 17.5% Ni; about 2.5% Si; at least 0.04% of Mg, less than 0.05% P, and less than 0.01% of S. In another embodiment this cast iron material making the exhaust manifold has about 2.6% carbon, and is substantially free of copper and aluminum.

BRIEF DESCRIPTION OF THE INVENTION

DETAILED DESCRIPTION OF THE INVENTION

Figure 1:
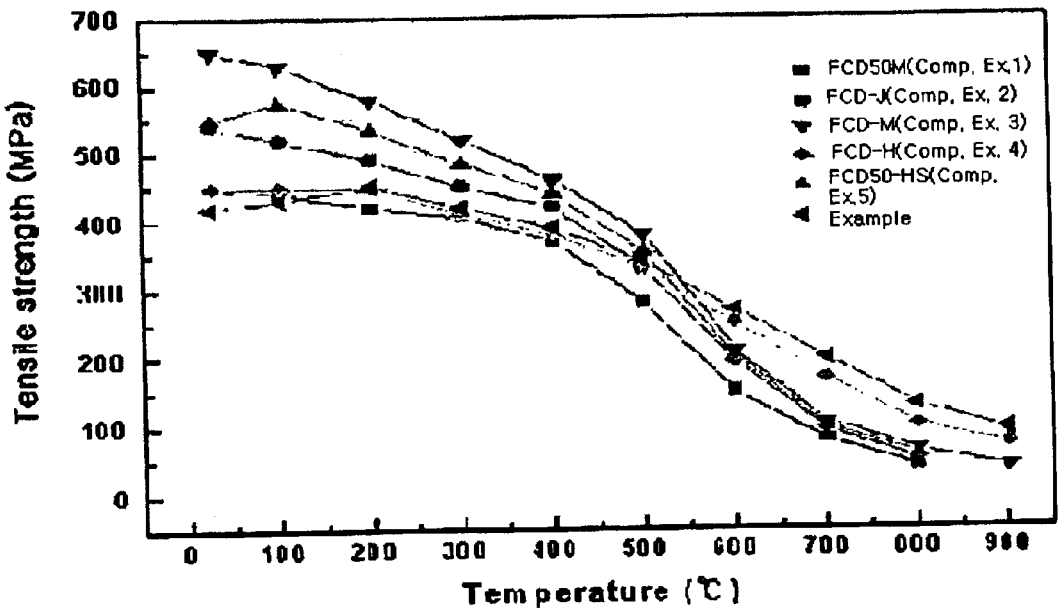
FIG. 1 is a graph showing tensile strength over time of an Example of the present invention and Comparative Examples.

The present invention provides cast iron suitable for an exhaust manifold. In one embodiment the cast iron of the present invention comprises:

2.5 to 3.0% of C, for example 2.6 to 2.8% of C;

2.0 to 3.0% of Si, for example 2.4 to 2.7% of Si;

0.8 to 1.2% of Mn, for example 0.9 to 1.1% of Mn;

0 to 0.1% of P, preferably less than 0.05%, for example 0.001 to 0.02% of P;

0.001 to 0.02% of S, for example 0.001 to 0.01% of S;

1.7 to 3.0% of Cr, for example 2.6 to 3.0% of Cr;

0.025 to 0.06% of Mg, for example 0.03 to 0.05% of Mg;

0.15 to 0.4% of Mo, for example 0.2 to 0.3% of Mo;

17.0 to 20.0% of Ni, for example 18 to 19% of Ni; and balance of Fe to the cast iron.

In one embodiment, the material of the present invention is substantially free, for example less than 0.1%, preferably none, of copper. In one embodiment, the material of the present invention is substantially free, for example less than 0.1%, preferably none, of aluminum.

The cast iron of the present invention exhibits superiority in properties such as high temperature oxidation resistance and high temperature strength, and is thus suitable for exhaust manifold of automobiles. The cast iron has austenitic structure. Without being bound by theory, among the cast iron elements, it is believed that Si, Mo, Cr, and Ni are particularly effective for improving oxidation resistance at high temperatures, and each amount used has an influence on quality of the product.

Conventional FCDs such as FCD-H have ferrite structure and among them, Mo is typically absent and Si is presented in the range of 3.2 to 3.8%. The content of Si in FCD-H is higher than other cast iron, and we believe it stabilizes the ferrite structure and increases Al transformation temperature to inhibit phase transformation. Therefore, it is advantageous to have increased amounts of Si with materials for high temperature strength.

On the other hand, prior art FCD-50 contains a restricted Si which is 1.7 to 3.0% and 0.4 to 0.6% of Mo which is different from FCD-H. See Table 1 for the composition of the related example FCD-50M.

The reasons for the limits on the contents of constituent elements of a cast iron composition according to the present invention will be described in further detail below. Unless otherwise stated, all compositions are in weight percent.

Ni serves to improve oxidation resistance like Cr and maintains high temperature strength. Ni is beneficially added in an amount of at least about 15%, and is limited in part by increasing price of the resultant material, and is present for example at about 17%, preferably in the range of 17.0 to 20.0%, for example at about 17.5%.

Si serves as a deoxidizing agent and is effective for improving strength and fatigue strength and further balancing the strength and flexibility. Si is added in the range of at least 1.7%, preferably between 2.0% and 3.0%, for example at about 2.5%.

Carbon hardens the structure related to elongation and lowers moldability. The smaller the content of C the better. The C content may range for example below about 4%, but preferably is restricted to the range of 2.5 to 3.0%, for example at about 2.6%.

Mn is effective for improving the strength by forming dispersoid within the structure without the heat treatment. In order to prevent lowering corrosion resistance and flexibility, the amount of Mn is preferably is restricted to 0.8 to 1.2%, for example at about 1%.

The presence of element P adversely affects the elongation of the cast iron. When the amount thereof is more than 0.1%, this adverse effect gets markedly worse. Thus, in order to guarantee an elongation, the content of P is restricted to about 0.1% or less, for example below about 0.04%.

The presence of element S adversely affects the corrosion resistance due to the production of sulfide compounds. When the amount of S is more than 0.02%, this adverse effect gets worse. Thus, it is desirable that the amount thereof be restricted to as small a level as possible. In the present invention, the content of S is restricted below 0.02%, but is typically present in an amount between about 0.001 to 0.02%, preferably less than 0.01%.

The element Mg is effective for decreasing heat diffusion and quality of the articles due to the production of oxide compounds and decreasing an elongation. Further, when the amount thereof is less than a lower limit, the strength is degraded. Mg is added in an amount of at least 0.025%, for example between 0.025 to 0.06%, for example at about 0.04%.

The element Mo is effective for improving oxidation resistance at high temperatures. Mo is added in an amount between 0.15 to 0.4%, for example at about 0.3%.

The element Cr is effective for improving oxidation resistance at high temperatures. Cr is added in an amount between 1.7% to 3.0%, for example at about 2.2%. In a high chromium embodiment, the metal has between 2.6 to 3.0% of Cr, for example about 2.8% Cr.

The cast iron of the present invention can be produced and worked substantially in accordance with conventional processes. The inventors have found that the cast iron of the present invention is austenitic structure having: at least 75%, typically at least 85%, for example at least 90%, to 100% of spherodization rate; a 10 to 70 μm graphite (grain) size; and between 0 to 5%, for example 0.01 to 2%, of glass cementite. The cast iron of the present invention can be used at a temperature of for example 850° C., which is higher than the recommended use temperatures of conventional cast irons FCD-H (below 730° C.) and FCD50-HS (750° C.).

Thus, the cast iron of the present invention can replace the conventional materials used for the exhaust system, and provides excellent heat resistance and oxidation resistance at high temperatures so that it is suitable for exhaust manifolds of automobile engines.

The invention will be understood more readily by reference to the following examples. However, these examples are intended only to illustrate the invention and should not be construed to limit the scope of the invention.

EXAMPLE AND COMPARATIVE EXAMPLES 1–5

In order to evaluate properties of the cast iron of the present invention and the conventional cast irons, the test pieces were prepared and the result is summarized in Table 2. Prior to testing, the cast iron was heated to 700±14° C. and this temperature was maintained for 1 hour. Then, the temperature was lowered to 300° C. in a furnace and then air-cooled. Test conditions were the same for all samples.

Tensile strength, yield strength, elongation and hardness of the test pieces determined in accordance with conventional processes are shown in Table 2. The structure of the test pieces, including spherodization rate, graphite grain size, and structure of the plate as shown in Table 3, were defined using scanning electron microscope data and using accepted methods.

TABLE 2

| | Trade Name | Tensile strength (kgf/mm$^2$) | Yield strength (kgf/mm$^2$) | Elongation (%) | Hardness (HB) |
|---|---|---|---|---|---|
| Example | | 40↑ | 21↑ | 7↑ | 150–220 |
| Comparative Example 1 | FCD50M | 50↑ | 33↑ | 5↑ | 170–241 |
| Comparative Example 2 | FCD-J | 50↑ | 33↑ | ↑ | 170–241 |
| Comparative Example 3 | FCE-M | 63↑ | 50↑ | 2↑ | 187–241 |
| Comparative Example 4 | FDC-H | 40↑ | 35↑ | ↑ | 170–241 |
| Comparative Example 5 | FCD50-HS | 50↑ | ↑ | ↑ | 170–241 |

Strength Test at High Temperatures:

Generally the strength of a metal is determined at room temperature, but for exhaust manifolds where actual operation is at a high temperature the properties are more important at high temperatures. Surprisingly, the high temperature properties are reversal to the low temperature properties as shown in the following Table 4 and FIG. 1. A preferred cast iron material will have, at the operating temperature, a tensile strength of at least 10 kgf/mm$^2$, more preferably at least 15 kgf/mm$^2$. It can be seen from the tabular data that, at 600° C., all of the oxidation resistant cast irons including the iron of the present invention met or exceeded the preferred strength. At 700° C., all but one of the prior art oxidation resistant cast irons, and also the iron of the present invention, met the at least 10 kgf/mm$^2$ standard. However, only the iron of the present invention and the comparative example 5 (FCD-50-HS), met the at least 15 kgf/mm$^2$ standard. At 800° C., only the iron of the present invention and the comparative example 5 (FCD-50-HS), met the at least 10 kgf/mm$^2$ standard.

TABLE 3

| | Materials | Spherodization rate (%) | Graphite size (μm) | Structure | Ref. |
|---|---|---|---|---|---|
| Example | | 75 ÿ | 70 ÿ | Austenitic | ÿ |
| Comparative Example 1 | FCD50M | ÿ | 60 ÿ | Ferrite (95% ÿ) + Perlite | 5 ÿ |
| Comparative Example 2 | FCD-J | ÿ | 60 ÿ | Ferrite + Perlite | ÿ |
| Comparative Example 3 | FCE-M | ÿ | — | Ferrite + Perlite (40% ÿ) | ÿ |
| Comparative Example 4 | FDC-H | ÿ | — | Ferrite + Perlite (20% ÿ) | ÿ |
| Comparative Example 5 | FCD50-HS | 80 ÿ | 100 ÿ | Ferrite + Perlite (10% ÿ) | ÿ |

TABLE 4

| Category | Tensile strength (kgf/mm$^2$) | | | | | |
|---|---|---|---|---|---|---|
| Temp. (° C.) | Example 1 | Com. Exam. 1 | Com. Exam. 2 | Com. Exam. 3 | Com. Exam. 4 | Com. Exam. 5 |
| 0 | 42 | 45 | 54 | 65 | 55 | 45 |
| 100 | 43 | 44 | 52 | 63 | 57 | 45.5 |
| 200 | 45 | 42 | 49 | 58 | 53 | 45.7 |
| 300 | 42 | 41 | 45 | 52 | 48 | 40 |
| 400 | 39 | 39 | 42 | 46 | 43 | 38 |
| 500 | 34 | 28 | 33 | 37 | 35 | 34 |
| 600 | 26 | 15 | 18 | 20 | 20 | 25 |
| 700 | 20 | 7.5 | 10 | 10 | 10 | 16 |
| 800 | 12.5 | 4 | 5.5 | 6 | 5 | 10 |
| 900 | 9 | — | — | 4 | — | 7.5 |

Interpolation of the data between 800° C. and 900° C. shows that at 850° C., only the iron of the present invention has a tensile strength of at least 10 kgf/mm$^2$.

As is clear in Table 4 and FIG. 1, tensile strength of the test pieces of Comparative Examples 1–5 are at least 75 Mpa at a temperature of 730° C. to 750° C. This strength at this temperature does not guarantee satisfactory strength for the exhaust system of automobiles of which temperature of the exhaust manifold can reach 850° C. to 900° C. The strength of the test piece of the present invention is lower than those of Comparative Examples 1–5 with respect to the tensile strength at a room temperature, but is particularly superior with respect to the high-temperature strength. It was thus confirmed that the cast iron the present invention is suitable in terms of high temperature strength for portions of the exhaust equipment members such as exhaust manifolds.

Structure:

It can be seen in Table 3 that the structure of the metal of the current invention is substantially austenitic. The conventional prior art oxidation resistant cast irons exhibited structures of Ferrite and Perlite. Perlite is an eutectic between Ferrite and Cementite (a carbide of iron).

Figure 2:
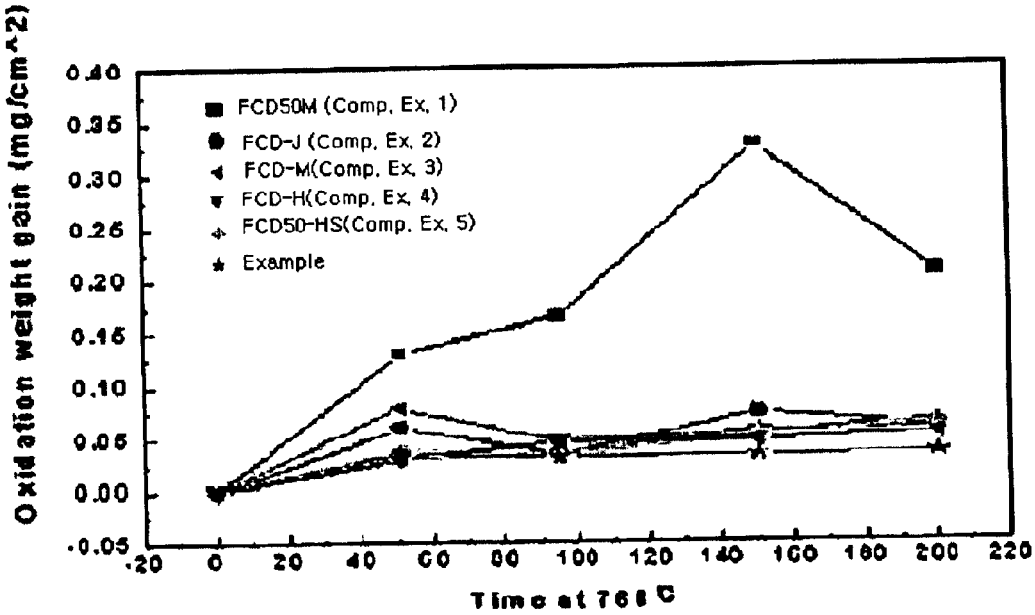
FIG. 2 is a graph showing oxidation resistance of Example of the present invention and Comparative Examples.

Oxidation Resistance Test at High Temperatures:

Rod test pieces having a diameter of 5 mm and a length of 10 mm of the Example of the present invention and of the Comparative Examples 1–5 were kept in air at 760° C. for 200 hours. The oxide scale that formed was removed by a shot blasting treatment to measure a weight variation per a unit surface area every 50 hours. The results are summarized in Table 5 and FIG. 2.

TABLE 5

| Category Time (hr) | Weight variation ($mg/cm^2$) Example 1 | Com. Exam. 1 | Com. Exam. 2 | Com. Exam. 3 | Com. Exam. 4 | Com. Exam. 5 |
|---|---|---|---|---|---|---|
| 0 | 0 | 0 | 0 | 0 | 0 | 0 |
| 50 | 0.036 | 0.14 | 0.06 | 0.08 | 0.03 | 0.06 |
| 100 | 0.032 | 0.18 | 0.04 | 0.05 | 0.05 | 0.035 |
| 150 | 0.033 | 0.33 | 0.07 | 0.05 | 0.06 | 0.07 |
| 200 | 0.035 | 0.22 | 0.06 | 0.05 | 0.06 | 0.06 |

As is clear from Table 5 and FIG. 1, Comparative Example 1 (FCD50M) which contains low content of Si and no Mo exhibited inferior oxidation resistance compared to Comparative Examples 2–5 from the beginning of experiment. Since the oxide scale of Comparative Example 1 was so high, it was concluded that the content of Si and Mo had an influence on oxidation resistance at high temperatures and high temperature strength. The cast iron containing Ni element showed both excellent heat resistance and excellent high temperature oxidation resistance. Advantageously, a cast iron alloy exhibits less than about 0.05, preferably less than about 0.04, milligrams per square centimeter when exposed to air at 760° C. for 50 hours and also when exposed to air at 760° C. for 200 hours when being cleaned every 50 hours. The cast iron of the present invention exhibited, when exposed to air at 760° C. for 50 hours, oxide formation of between about 0.032 and 0.036 milligrams per square centimeter, averaging 0.034 milligrams per square centimeter over 200 hours when cleaned every 50 hours. The comparative examples 2–5 exhibited oxide formation of between about 0.035 and 0.07 milligrams per square centimeter, averaging 0.055 milligrams per square centimeter over 200 hours when cleaned every 50 hours. For example, the comparative example 5 (FCD-50-HS) exhibited oxide formation of between about 0.035 and 0.07 milligrams per square centimeter, averaging 0.056 milligrams per square centimeter over 200 hours when cleaned every 50 hours. The cast irons of the present invention therefore exhibit considerably less high temperature corrosion than any of the prior art oxidation resistant cast irons.

As described above in detail, the cast iron of the present invention is prepared by restricting amounts of Si, Mo and Ni and exhibits superior heat resistance and oxidation resistance at high temperatures to the conventional cast irons. It is thus suitable for automobile exhaust systems exposed to the severe conditions.

What is claimed is:

1. A cast iron for an exhaust manifold, the cast iron comprising:

2.5 to 3.0 weight % of C;

2.0 to 3.0 weight % of Si;

0.8 to 1.2 weight % of Mn;

0 to 0.1 weight % of P;

0.001 to 0.02 weight % of S;

1.7 to 3.0 weight % of Cr;

0.025 to 0.06 weight % of Mg;

0.15 to 0.4 weight % of Mo;

17.0 to 20.0 weight % of Ni; and balance of Fe to the cast iron.

2. The cast iron of claim 1, wherein the cast iron has an austenitic structure having 75% to 100% of epherodization rate, 10 to 70mm of graphite grain size, and 0 to 5% of glass cementite.

3. The cast iron of claim 1, wherein the cast iron comprises 2.4 to 2.7% of Si; 0.001 to 0.02% of P; 0.001 to 0.01% of S; and 0.03 to 0.05% of Mg.

4. The cast iron of claim 1, wherein the cast iron comprises 2.6 to 2.8% of C; 0.9 to 1.1% of Mn; less than 0.05% of P; less than 0.01% of S; 2.6 to 3.0% of Cr; 0.2 to 0.3% of Mo; and 17.0 to 19.0% of Ni.

5. The cast iron of claim 2, wherein the cast iron comprises 2.6 to 2.8% of C; 2.4 to 2.7% of Si; 0.9 to 1.1% of Mn; less than 0.05% of P; 0.001 to 0.01% of S; 2.6 to 3.0% of Cr; 0.03 to 0.05% of Mg; less than 0.01% of S; and 0.2 to 0.3% of Mo.

6. The cast iron of claim 1, wherein the cast iron comprises about 17.5% of Ni.

7. The cast iron of claim 5, wherein the cast iron comprises about 17.5% of Ni.

8. The cast iron of claim 1, wherein the cast iron is substantially free of copper and aluminum.

9. The cast iron of claim 1, wherein the cast iron has a tensile strength of at least 10 $kgf/mm^2$ at a temperature of 700° C.

10. The cast iron of claim 1, wherein the cast iron has a tensile strength of at least 15 $kgf/mm^2$ at a temperature of 700° C.

11. The cast iron of claim 1, wherein the cast iron has a tensile strength of at least 10 $kgf/mm^2$ at a temperature of 800° C.

12. The cast iron of claim 1, wherein the cast iron exhibits less than about 0.05 milligrams of metal conversion to oxide per square centimeter when exposed to air at 760° C. for 50 hours.

13. The cast iron of claim 1, wherein the cast iron has a tensile strength of at least 75 Mpa at a temperature of 800° C.

14. The cast iron of claim 1, wherein the cast iron exhibits less than about 0.04 milligrams of metal conversion to oxide per square centimeter when exposed to air at 760° C. for 50 hours.

15. An exhaust manifold containing a cast iron material of claim 1.

16. An exhaust manifold containing a cast iron material of claim 3.

17. An exhaust manifold containing a cast iron material of claim 5.

18. An exhaust manifold comprising a cast iron material contacting a channel adapted for conveying exhaust gas or the outside air or both, said cast iron material having 2.5 to 3.0% of C; 2.0 to 3.0% of Si; 0.8 to 1.2% of Mn; less than 0.1% of P; less than 0.02% of S; 1.7 to 3.0% of Cr; 0.025 to 0.06% of Mg; 0.15 to 0.4% of Mo; 17.0 to 20.0% of Ni; and a balance of iron, wherein the cast iron has a tensile strength of at least 10 $kgf/mm^2$ at a temperature of 800° C.

19. The exhaust manifold of claim 18, wherein the cast iron material comprises about 17.5% Ni; about 2.5% Si; at least 0.04% of Mg, less than 0.05% P, and less than 0.01% of S.

20. The exhaust manifold of claim 19, wherein the cast iron material comprises about 2.5% Cr, and is substantially free of Cu and Al.

* * * * *